United States Patent [19]

Christensen

[11] 3,970,193

[45] July 20, 1976

[54] LATCHABLE MATCHBOOK WITH DIVIDING STRIKING STRIP

[76] Inventor: Donald Ragnvald Christensen, 21790 Ybarra Road, Woodland Hills, Calif. 91364

[22] Filed: Aug. 29, 1975

[21] Appl. No.: 609,085

[52] U.S. Cl. ..... 206/104; 206/106; 206/112

[51] Int. Cl.[2] ..... A24F 27/00

[58] Field of Search ..... 206/90, 98–100, 206/103–104, 106, 108–109, 112–114

[56] References Cited

UNITED STATES PATENTS

| | | | |
|---|---|---|---|
| 2,077,023 | 4/1937 | Spira | 206/109 |
| 2,116,231 | 5/1938 | Beyer | 206/106 |
| 2,199,610 | 5/1940 | Berry | 206/109 |
| 2,350,144 | 5/1944 | Barros | 206/112 |
| 3,891,083 | 6/1975 | Roth | 206/98 |

*Primary Examiner*—Steven E. Lipman

[57] ABSTRACT

A matchbook which requires complete closure to obtain a usable match-striking surface. Only then does an interior-mounted row of spaced protuberances occupy similarly spaced, complementary holes in a striking strip on the matchbook's openable flap to provide a continuous area of adequate size for match-striking purposes. A latch system is an additional safety feature; the elementary moves of young children will not open it, because the matchbook's openable flap remains trapped by an inwardly-turned, slotted ridge unless appropriate coordinated actions are taken.

4 Claims, 8 Drawing Figures

FIG. 5
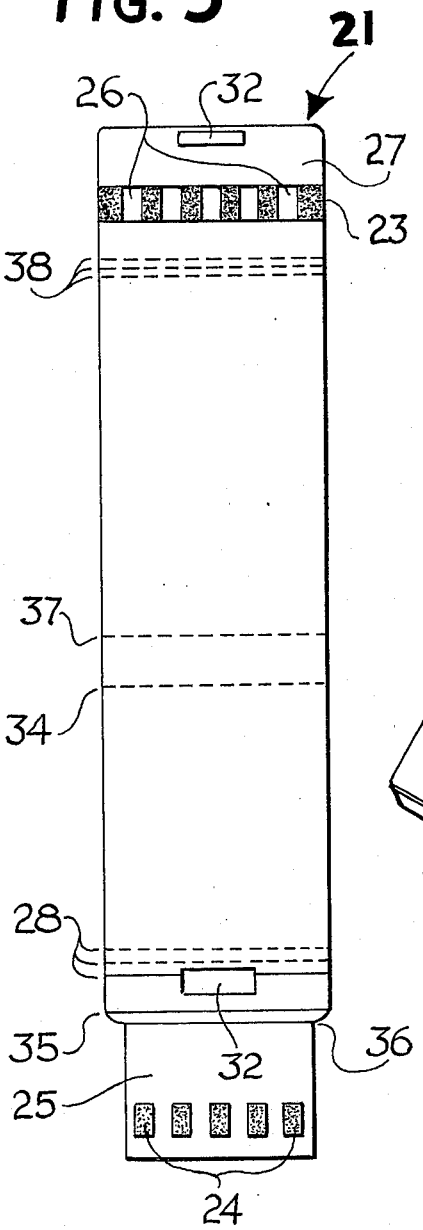
FIG. 6
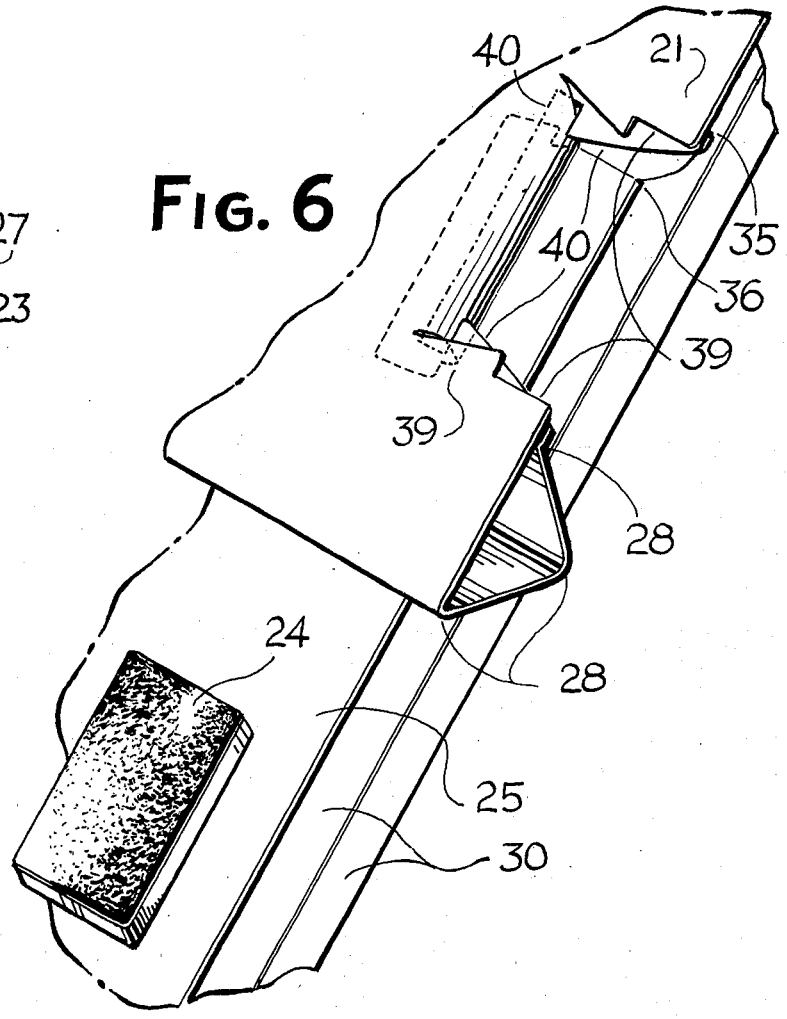
FIG. 7
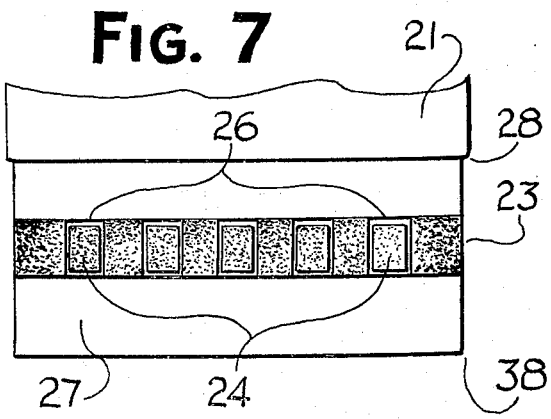
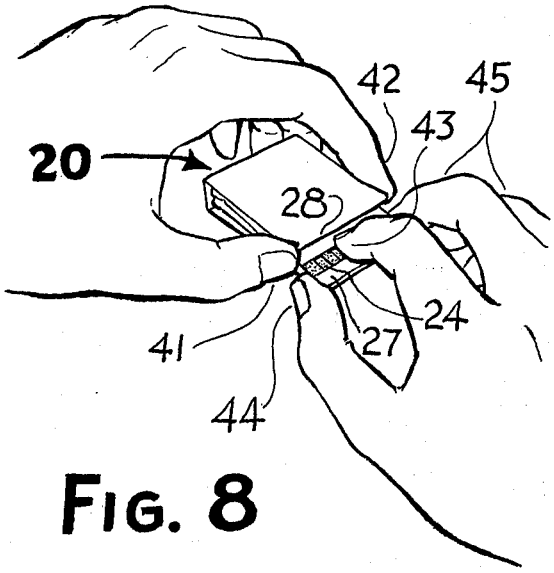
FIG. 8

LATCHABLE MATCHBOOK WITH DIVIDING STRIKING STRIP

BACKGROUND OF THE INVENTION

For years there has been widespread recognition that easy access to matches by small children annually produces thousands of fire accidents which destroy lives and property. According to reliable accountings, thousands of so-called exploding match burn-accidents also involve adult matchbook users failing to heed the printed warning on every matchbook: "Close Before Striking". In both categories, the long-prevailing design of matchbooks has been at fault, yet no corrective changes have been forthcoming. With production of matchbooks in this country totalling over 500 million units each year, and with millions of people each year jeopardized or affected by fire dangers, an improvement endowing matchbooks with a far greater degree of safety would in time mean values beyond measure.

However, it may be assumed that to be accepted by, and integrated into, a large manufacturing system, of necessity such an improvement must involve minimal changes and retooling of existing production facilities. It must utilize paper stock and matches presently favored by the matchbook industry, and current assembly procedures must find it generally compatible. It is with such considerations that the applicant has designed the matchbook of this invention.

SUMMARY OF THE INVENTION

While typical in size, paper stock and general appearance, this matchbook embodies features of new invention that are mechanical in nature and function. It has an innovative fold-system which produces the structure and strength needed to support a latching effect with merely paper components: Centrally located at the closing edge of the matchbook's openable flap is an upraised part which in closed position is trapped and held by a slotlike opening in an interior plane of an inwardly-turned elongated ridge. The flap cannot be withdrawn by a direct pull, such as might be used by a child, but is easily released by simple lift-press-lift finger movements coordinated according to instructions on the matchbook cover.

The machbook's interior supply of matches is exposed on the side of the opened cover that is opposite the match-striking side. However, while open the matchbook's striking strip is without firm support, being located on the flap end of the cover; but making it completely unusable is a row of spaced holes in the strip. After tearing a match from its match comb side, the matchbook must be turned by the user to its earlier position and is flap end secured in the closed position. This is easily accomplished while holding an unlighted match, since there is little resistance to the flap end when it is inserted beneath the trapping ridge. With the flap secured, the spaced holes in the striking strip are occupied by complementary protuberances which were separated from them by the opening of the matchbook, because the slightly upraised protuberances are mounted on the interior base of the thusly enclosed matches. The fact that an effective match-striking area is only available when the matchbook is closed can be a guarantee that its use will make impossible such accidents as those involving exploding or separating match heads, even dropped matches, igniting an entire open matchbook. Just as it also provides assurance that matches securely latched within its cover will be far less accessible to children. Just as tearing it open will mean damage which may interfere with subsequent use of its dividable striking strip.

BRIEF DESCRIPTION OF THE DRAWING

FIG. 5 is a plan view of the cover of the matchbook, with cuts and openings shown, along with indicated locations of subsequent folds;

FIG. 6 is an enlarged detail view of a portion of FIG. 2, showing alternate means of attaching two layers of the matchbook cover, one to the other;

FIG. 7 is an enlarged plan view of the striking strip, showing the spacing of protuberances and their complementary holes; and FIG. 8 is a pictorial view showing a preferred placement of fingers in order to unlatch and open the matchbook of this invention.

DESCRIPTION OF THE SHOWN EMBODIMENT

Figure 1:
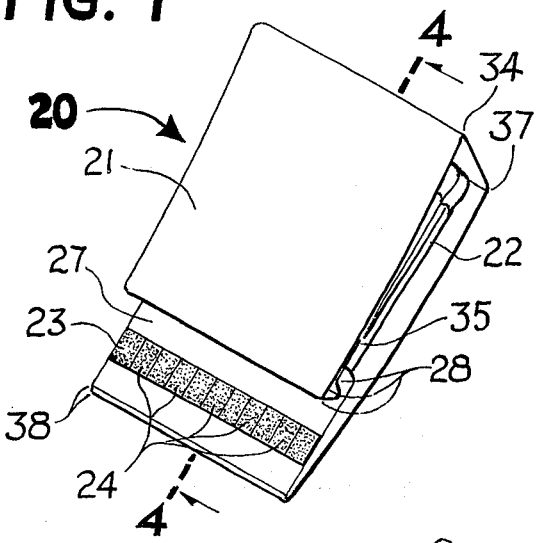
FIG. 1 is a pictorial view of a presently preferred form of the matchbook invention with its cover closed and its striking strip complete.

As shown in FIG. 1, the general appearance of matchbook 20 and the material thickness of paper cover 21 closely resemble long prevailing matchbook form and material structure. Since matchbook 20 also contains various components known to the art, such as match comb 22 and the slightly abrasive coating of striking strip 23, it is therefore to be understood that such components as are indeed known to the art do not specifically form a part of this invention.

Completely new and unique, however, is the two-part mechanical character of its striking strip 23. In FIG. 1, this mechanical aspect is evident only in equally spaced rectangles 24, but with the matchbook 20 partly opened as in FIG. 2, the two parts of striking strip 23 are clearly evident: Rectangles 24 are a row of slightly upraised protuberances mounted on base portion 25 of match comb 22. In striking strip 23 is a matching row of spaced, complementary holes 26 which so reduce and interrupt its surface area that it cannot be effective as a striking strip. It also lacks necessary firm support for match-striking purposes, as long as the end of flap 27 is not secured beneath elongated, inwardly-turned ridge 28 as shown in FIG. 1. Spaced separations in the row of slightly upraised protuberances 24 make it an unusable striking area also, and individually each protuberance 24 provides too small a coated striking surface for effective ignition of a safety match. Only when the end of flap 27 is in closed position under elongated ridge 28, as shown in FIG. 1, can striking strip 23 become properly seated with holes 26 fully and squarely occupied by protuberances 24 to accomodate the lighting of a safety match on its adequate, continuous length of striking surface.

Figure 2:
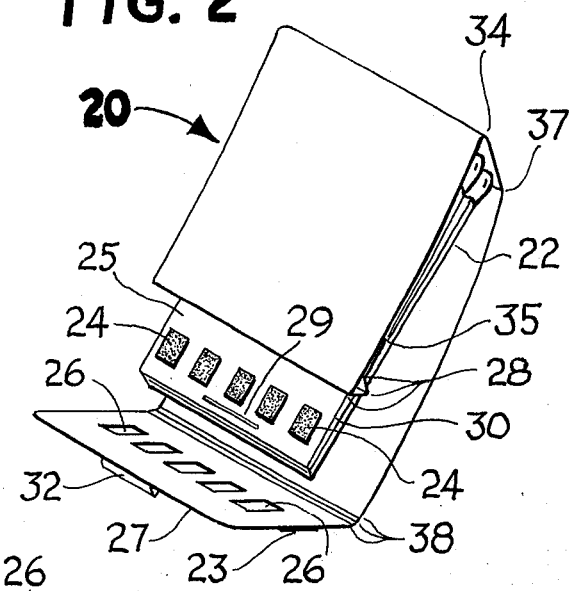
FIG. 2 is a similar pictorial view with the matchbook partly opened and showing the dividable character of its striking strip.

Any shape on the horizontal plane will serve the purpose of each protuberance 24 as long as it mates with a complementary hole in striking strip 23. In FIG. 2 the height of protuberances 24 is graphically exaggerated to clearly illustrate their upraised character, but actually the height of protuberances 24 is merely sufficient to match the material thickness of flap 27 and the slightly abrasive chemical coating of striking strip 23. The height of protuberances 24 is exaggerated also in enlarged sectional view FIG. 4 taken along line 4—4 of FIG. 1, as is the height of one protuberance 24 in FIG. 6, enlarged detail view of a portion of FIG. 2, showing an alternate means of attaching two layers of cover 21 together, one to the other. For purposes of this presentation it is to be understood that adhesive means are favored for this attachment, but not necessarily for securing base 25 to an interior plane. As in FIG. 3, cover 21 is shown to be fastened by two wire staples 29, in a secure parallel attachement, to a pair of match combs 22. One staple 29 is near and parallel to edge of base 30, a surface area about twice that of usual match comb bases. In a similar parallel attitude, another staple 29 is located in base 30 in close proximity to the attached ends of the matches in each match comb 22.

Figure 4:
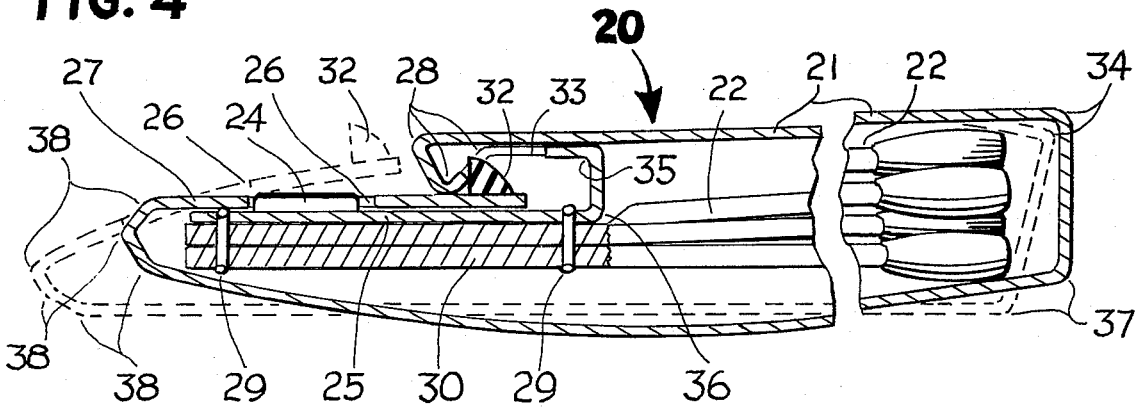
FIG. 4 is an enlarged sectional view taken along line 4 — 4 of FIG. 1 in which is shown the structural form of the matchbook and relationships of various folds and cuts.

The relationships of staples 29 to structural parts on a vertical plane of matchbook 20 are shown in enlarged sectional view FIG. 4. It may be fairly assumed that such wire staples 29 can be pressed through the materials of cover 21 and match bases 30 from either direction without a relevant difference in their fastening strength and effectiveness, which is to maintain continuing attachment of match cover 21 at its base portion 25 to match combs 22 through their base portions 30.

Figure 3:
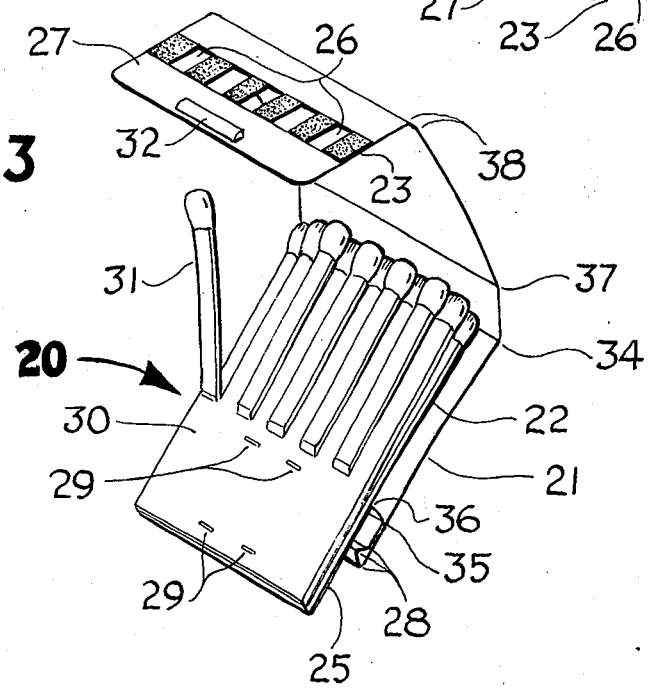
FIG. 3 is a pictorial view of the matchbook in which the opposite side, from which matches can be removed, is uppermost, with the openable part swung clear.

In FIG. 3 a match 31 is shown bent away from the line of matches in upper most match comb 22 to demonstrate their availability when cover 21 has been unwrapped to this sufficient extent and said match comb 22 has been turned toward the user. After a match 31 has been torn from match comb 22 and is being held presumably between a thumb and forefinger, matchbook 20 is turned to its earlier position and the upraised member 32 at the endmost and closing edge of flap 27 must be inserted under elongated ridge 28. This is easily accomplished with little resistance since the recessing slant of the forward plane of ridge 28 is caused to ride up the sloped or rounded face of upraised member 32 and permit it to slip past. After which, ridge 28 lowers behind it, and flap 27 is positioned to settle or be slightly adjusted so that protuberances 24 intrude into and are surrounded by the perimeters of complementary holes 26 in striking strip 23.

As shown in FIG. 1 and FIG. 4, the chemically coated, slightly abrasive top surfaces of protuberances 24 must be on a horizontal plane closely, if not precisely, matching that of the adjacent, coated surface areas of striking strip 23. On the continuity of striking surface that is thereby provided, the head of safety match 31 can be scratched and ignited. The balance of matches in match combs 22 are shielded by their enclosure, for the most part, completely within the closed coverage of cover 21. Apparent in sectional view FIG. 4 is the unique latch-effect provided by the invention. From closed position, flap 27 cannot be withdrawn by a direct pull without tearing-damage to cover 21 in the central area of elongated ridge 28, which resists such withdrawal of upraised member 32 on flap 27. The resisting means, which is not externally visible, is profiled in enlarged sectional view FIG. 4 as slot 33, an opening in the most inward plane of elongated ridge 28, which allows the generally vertical, straight side of upraised member 32 no opportunity to be moved from this entrapment unless ridge 28 is raised a distance sufficient to clear it. However, resistance to such raising is imparted to the portion of cover 21 adjacent to fold 28 on the outer plane, which ends at fold 34, by its firm attachment to the interior portion between fold 35 and the nearest fold 28. The very short distance between fold 35 and fold 36 serves also to maintain the close relationship of elongated ridge 28 to base portion 25 of cover 21 in the area close to fold 36. The resistance of ridge 28 to being lifted enough to clear upraised member 32 can be countered, however, by simultaneous depressing of flap 27 at a central point closely adjacent to the entrapped member 32 as flap 27 is being withdrawn. As upraised member 32 clears the restriction of ridge 28, flap 27 must then be lifted to free it from protuberances 24. At which point, unrestrained, it may be swung fully open to expose match combs 22, mounted on the opposite side of cover 21. During the disengagement of flap 27, its clearing of ridge 28 is aided by slanting of the plane between fold 34 and 37 to advance that portion of cover 21 defined by fold 37, folds 38 and the endmost edge of flap 27 in the direction that flap 27 is being moved. Such slanting of plane 34–37 is of course simply in response to an outward pulling-while-lifting action applied at flap 27 as, and after, upraised member 32 is disengaged from the trapping edge of elongated ridge 28.

In plan view FIG. 5, which shows cover 21 before folding, the locations of folds to be made are seen as broken lines, in the case of convex folds, and as light, solid lines in the case of concave folds, of the surface plane shown. There are just three concave bends, and reference to FIG. 4 enlarged sectional view reveals them as fold 36, fold 35 and the nearest adjacent fold 28.

In FIG. 5 the plan view of cover 21 shows base 25 as having a lesser width than the main body of the piece. This reduction need only be sufficient to match the width of base 30 of match combs 22 which base 25 is to be fastened to, by adhesive means or other manner of firm attachment. No single size or set of proportions pertains, however, in the production of matchbook 20. Its general configuration can be altered to suit various size requirements. Also, while protuberances 24 in this preferred form are rectangular, with complementary holes 26 in flap 27 portion at the opposite end of cover 21, such rectangular shapes are not a fixed requirement of protuberances 24. Any shape or varied shapes will permit their function as long as each protuberance 24 fits appropriately but not restrictively in a complementing hole which occupies a fractional part of the chemically coated, slightly abrasive striking strip 23 area of flap 27. The top surface of each protuberance 24 is of course coated with a strike surface material used also on strip 23. Clearly evident in FIG. 5 plan view, also, is the rectangular opening 33 which becomes the previously described slot 33 in the folded structure. Its longest dimension is parallel to indicated lateral folds, and its placement bisects the single concave fold 28, while being just slightly separated from the nearest convex fold 28. The slight separation contributes to the strength of adjacent fold 28 in its resistance to the direct withdrawal of upraised member 32 from entrapment in slot 33 when flap 27 is in closed position, as shown in FIG. 4. The exterior slanting plane of ridge 28 gains support, and resistance to tearing, from the fold and quartering angle of this interior plane.

It must be noted that the triangular rigidity of elongated ridge 28 is dependent on the firm attachment of immediately adjacent portions of cover 21, each to the other. An alternative to adhesive means is the method shown in FIG. 6, an enlarged detail view of a portion of FIG. 2. It is comprised of a mating tab 39 and slot 40 in the edges of those portions of cover 21 that are adjacent to ridge 28. The width of tab 39 should be as wide as possible within limits determined by space available for its mating slot 40 in the part of cover 21 that is between concave fold 28 and fold 35. The length or inward measure of tab 39 need not equal or surpass its width, providing it is long enough to facilitate its being bent and pressed into and under the restrictive hold of slot 40. As shown, the shapes of slot 40 and of tab 39 contribute to the security of such an interlock. Its use must be complemented by a mirror image reversal of the combination similarly located on the edges of cover 21, directly opposite the portion of FIG. 2 shown in FIG. 6. With the two layers of cover 21 firmly joined, a stiffening effect is achieved to maintain the close relationship of ridge 28 to the surface of base 25 and impart a spring-back quality when ridge 28 is lifted.

In FIG. 7, a plan view of striking strip 23 with protuberances 24 occupying complementary holes 26, a slight exception is shown. Whereas protuberances 24 fit closely but not restrictively within the confines of three sides of each hole 26, there is added space on the side closest to ridge 28. This extra space is provided to keep edges of holes 26 from being wedged against the vertical faces of protuberances 24 during the withdrawal and lifting of flap 27 from the entrapment of ridge 28. However, this slightly increased space does not lessen the supplemental resistance of the vertical faces of protuberances 24 to outward movement of flap 27 on the same plane, as when a direct pulling action is used to disengage it from the hold of ridge 28. Only with properly coordinated lifting of ridge 28 while pressing flap 27 near entrapped member 32, while also withdrawing, then lifting flap 27 can it be readily freed of the confinement of ridge 28 and its engagement with row of protuberances 24.

Pictorial view FIG. 8 shows preferred finger placements for such synchronously coordinated opening procedure. The following sequence applies: With thumb 41 and forefinger 42, of one hand, lifting ends of inwardly-turned elongated ridge 28 just enough to gain a small measure of increased separation between ridge 28 and flap 27 while forefinger 43 of other hand presses on flap 27 in the central area close to its concealed and entrapped upraised member 32 and thereby increases the separation an amount sufficient to permit withdrawal of upraised member 32 from the confinement of slot 33 in the interior plane of ridge 28, such withdrawal is motivated by the grasp and outward pull of thumb 44 and other fingers 45 acting in coordination with forefinger 43 so that the unlatching of member 32 can be closely followed by a lifting of flap 27 clear of the protuberances 24 which restrict its movement on a horizontal plane, but not otherwise. Since upraised member 32 and slot 33 are not visible in pictorial view FIG. 8, their relationship to the action and one to the other must be understood as shown in FIG. 4. Also evident in this sectional view is the rounded or sloping face of member 32 which causes the slanting exterior plane of ridge 28 to ride up and permit its replacement by a simple finger push action easily accomplished while holding a match 31 withdrawn for striking when matchbook 20 is properly closed.

I claim:

1. In a matchbook containing detachable matches which require generation of friction between the head of each match and a slightly abrasive chemical coating in order to cause their ignition and burning, as a new feature of invention, improvements comprising:

an effective surface area for match-striking purposes produced by a plurality of appropriately placed, shaped and surfaced parts being joined in a common plane only when said matchbook is closed;

a division of the total such assemblage being an integral part of, or mounted on, a supporting base portion of the matchbook contents;

a complementary, mating division of the total such assemblage being a part of that portion of the sheetlike cover of said matchbook which is movable for purposes of opening and closing said matchbook.

2. An apparatus as defined in claim 1 wherein:

the division that is a part of the movable portion of said matchbook cover has within it at least one hole-opening which, when said matchbook is in closed form, is placed in complementary engagement with at least one separately mounted protuberance to mutually provide a common, continuous plane.

3. An apparatus as defined in claim 2 wherein there are unique structural features comprising:

a system of folds producing, in the enclosure form of said matchbook cover, a reinforced edge embodying an elongated ridge turned inwardly in facing opposition to a transverse plane, thereby creating an interior pocket in the otherwise sheetlike material structure of said matchbook cover;

an opening, a hole or aperture, located in an accessible plane or portion of said elongated ridge;

an upraised member on the movable portion of said matchbook cover, so located as to become trapped in said opening when the endmost edge of said movable portion is inserted to a position under and behind said elongated ridge; a sloping or rounded side of said member allowing its unresisted insertion, while an opposite vertical side, when blocked by a firm, restraining edge of said opening, prevents direct withdrawal of said upraised member of said movable portion.

4. In a matchbook containing detachable matches which require generation of friction between the head of each match and a slightly abrasive chemical coating in order to cause its ignition and burning, as a new feature of invention, improvements comprising:

unique structural features in a system of folds producing in the enclosure form of said matchbook cover a reinforced edge embodying an elongated ridge turned inwardly in facing opposition to a transverse plane, thereby creating an interior pocket in the otherwise sheetlike material structure of said matchbook cover;

an opening, a hole or aperture, located in an accessible portion of said elongated ridge;

an upraised member on the movable portion of said matchbook cover so located as to become trapped in said opening when the endmost edge of said movable portion is inserted to a position under and behind said elongated ridge; a sloping or rounded side of said member allowing its unresisted insertion, while an opposite vertical side, blocked by a restraining edge of said opening, prevents direct withdrawal of said upraised member of said movable portion.

* * * * *